US007520768B2

(12) United States Patent
Nicholson

(10) Patent No.: US 7,520,768 B2
(45) Date of Patent: Apr. 21, 2009

(54) CONNECTOR ASSEMBLY FOR USE WITH AN ELECTRICAL SUBMERSIBLE COMPONENT IN A DEEPWATER ENVIRONMENT

(75) Inventor: Joseph Allan Nicholson, Cumbria (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 133 days.

(21) Appl. No.: 11/830,286

(22) Filed: Jul. 30, 2007

(65) Prior Publication Data

US 2008/0227341 A1 Sep. 18, 2008

Related U.S. Application Data

(60) Provisional application No. 60/895,037, filed on Mar. 15, 2007.

(51) Int. Cl.
*H01R 4/60* (2006.01)

(52) U.S. Cl. ..... 439/190

(58) Field of Classification Search ..... 439/190–195
See application file for complete search history.

(56) References Cited

U.S. PATENT DOCUMENTS

| | | | | |
|---|---|---|---|---|
| 4,073,559 A | | 2/1978 | Lawson | |
| 4,901,069 A | | 2/1990 | Veneruso | |
| 5,427,268 A | | 6/1995 | Downing et al. | |
| 5,927,402 A | * | 7/1999 | Benson et al. | 439/191 |
| 5,967,816 A | * | 10/1999 | Sampa et al. | 439/190 |
| 6,315,497 B1 | | 11/2001 | Wittman et al. | |
| 6,332,785 B1 | | 12/2001 | Muench et al. | |
| 6,386,108 B1 | | 5/2002 | Brooks et al. | |
| 7,165,615 B2 | | 1/2007 | Vinegar et al. | |
| 7,194,902 B1 | | 3/2007 | Goodwin et al. | |
| 7,226,312 B2 | | 6/2007 | Shah | |

FOREIGN PATENT DOCUMENTS

| | | |
|---|---|---|
| GB | 2376250 A | 12/2002 |
| GB | 2408636 A | 6/2005 |

* cited by examiner

*Primary Examiner*—Tho D Ta
(74) *Attorney, Agent, or Firm*—Daryl R. Wright; Bryan P. Galloway; Tim Curington

(57) ABSTRACT

A connector for a connection assembly for providing electrical power to a submersible electrical component in a deepwater environment, such as a subsea well, includes a ceramic body having a metallized inner passageway. A conductive contact extends through the passageway and has a contact end and a cable connecting end. A conductive sleeve is disposed about an outer surface of the ceramic body. The ceramic body is retained within a connector housing that has an interface chamber and a cable retaining chamber. The contact end of the connector contact is disposed within the interface chamber, and the cable connecting end of the contact is disposed within the cable retaining chamber. The sleeve is attached to the housing to provide a seal between the interface chamber and the cable retaining chamber. When the connector is engaged with a complementary connector, a Faraday cage is provided within the interface chamber to manage the electrical field about the connection interface between the connectors.

23 Claims, 6 Drawing Sheets

CONNECTOR ASSEMBLY FOR USE WITH AN ELECTRICAL SUBMERSIBLE COMPONENT IN A DEEPWATER ENVIRONMENT

BACKGROUND

The present invention generally relates to a connector for use in a deepwater application, such as in a subsea oil or gas well.

A subsea oil or gas well includes various pieces of equipment which must be capable of withstanding harsh environmental conditions, including large temperature variations, high pressure differentials, thermal shock, and highly corrosive and abrasive surroundings. A conventional subsea well 10 is shown in FIG. 1 in which a wellhead 12 is located on the seabed 14. The well 10 may include a tubing string 16 which extends inside a casing 18 that lines a wellbore 19. The tubing string 16 includes a passageway for purposes of communicating well fluid to the wellhead 12. To aid in producing the fluid, the tubing string 16 may include an electrical submersible pump 20. The pump 20 typically is powered from the wellhead 12 by one or more electrical power cables 22. For instance, for a three-phase pump, three electrical cables 22 may extend from the wellhead 12 to the pump 20.

Due to the very nature of its operation, the electrical submersible pump 20 is surrounded by well fluid. A connection assembly 24 is used to connect the power cables 22 to the motorhead of the pump 20. The sealed connections formed by the assembly 24 should ideally maintain their integrity even in the relatively high temperature, high pressure and wet conditions that are present in the subsea well 10. The sealed connections also should maintain their integrity for long periods of time to avoid the costly task of removing and replacing the cables 22, pump 20 and/or the connection assembly 24 during the production life of the well 10.

Such a connection assembly may also be useful in deepwater (i.e., depths generally in excess of 1000 meters) applications other than a subsea well in which an electrical feedthrough must withstand a high temperature and high pressure environment. Thus, for instance, such a connection assembly may be used to provide an electrical connection to any of a variety of electrical submersible components, such as a transformer, multi-phase pump, subsea separator, etc.

Thus, there is a continued need for electrical connection assemblies that maintain their integrity in the harsh environmental conditions of a deepwater application.

SUMMARY

In an embodiment of the invention, an electrical connector includes a ceramic body having a metallized inner surface that defines a passageway extending through the ceramic body. The connector further includes a conductive contact disposed in the passageway. The contact has a cable connection end that extends from a first open end of the passageway and a contact end that extends from a second open end of the passageway. The connector also includes a sleeve disposed about an outer surface of the ceramic body to exert a gripping force on the ceramic body.

In another embodiment of the invention, a method of providing an electrical connection to a submersible component disposed in a well includes providing a ceramic body having a passageway extending therethrough, metallizing a wall of the passageway, and disposing a conductive contact in the passageway. The contact has a contact end extending from a first end of the passageway and a cable connecting end extending from a second end of the passageway. The method further includes attaching the cable connecting end to the ceramic body, disposing a sleeve about an outer surface of the ceramic body, and attaching the cable connecting end to an electrical conductor adapted to communicate electrical power to the submersible component.

In another embodiment of the invention, a system comprises an electrical submersible component a cable having an electrical conductor to provide electrical power to the component, and a connection assembly adapted to couple the electrical conductor to the component. The connection assembly comprises a first connector having a ceramic body that extends between a first chamber and a second chamber of a connector housing. The ceramic body has a metallized inner surface that defines a passageway that extends through the ceramic body. A conductive contact extends through the passageway, and a sleeve is disposed about an outer surface of the ceramic body. The sleeve is configured to seal the first chamber from the second chamber. The connection assembly also includes a complementary connector having a complementary conductive contact configured to attach to the electrical conductor. When the complementary conductive contact engages with the conductive contact, electrical power is provided to the electrical submersible component.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

Figure 1:
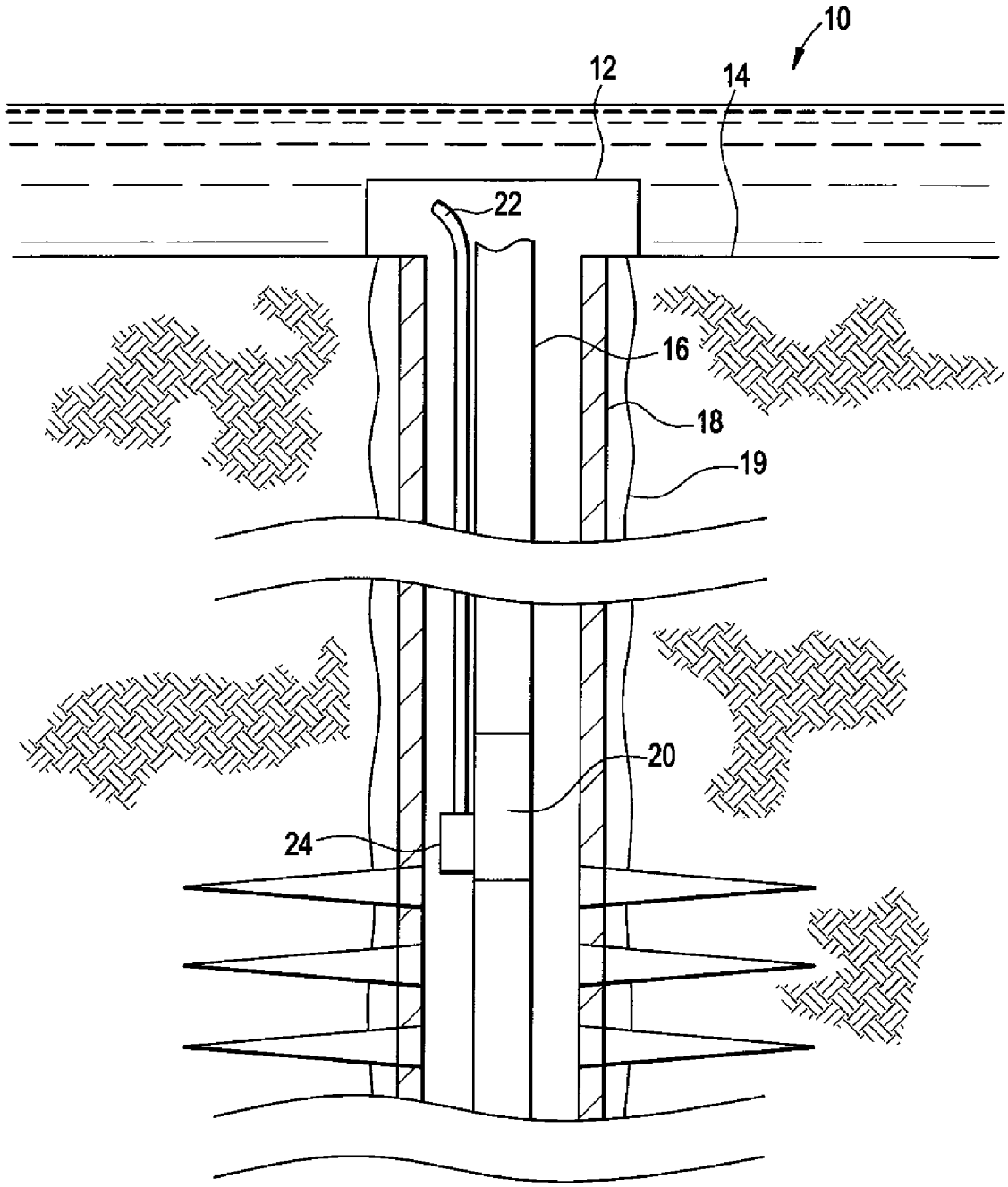
FIG. 1 is a diagram of a subsea well in which a pumping system is deployed
Figure 2:
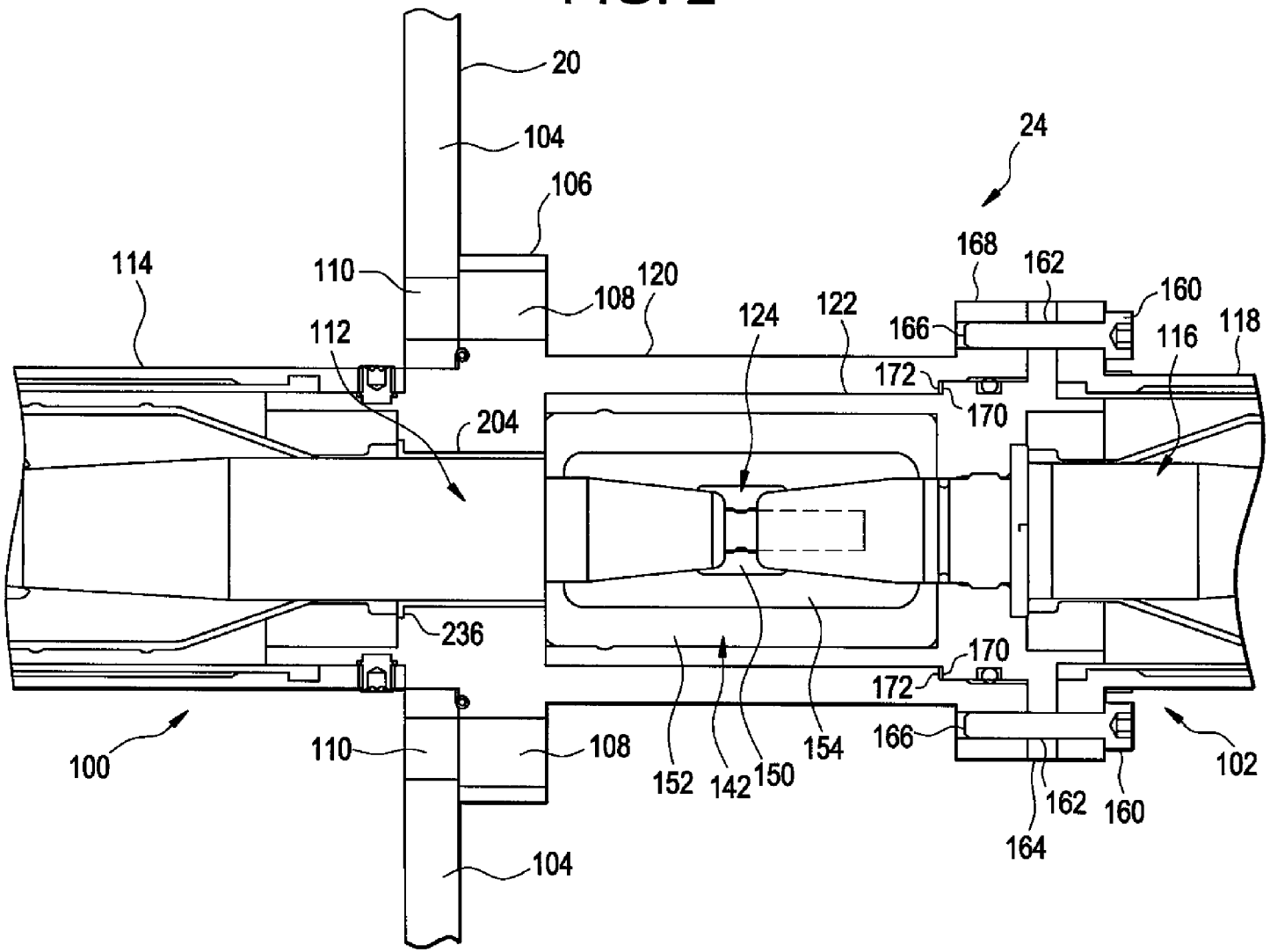
FIG. 2 is a cross-sectional view illustrating a connection assembly according to an embodiment of the invention.

Referring to FIG. 2, an embodiment of a connection assembly 24 in accordance with the invention is illustrated. The connection assembly 24 may be used to provide a sealed connection between motor lead extensions and a motorhead of a submersible component 20, such as an electrical submersible pump, inside a well (e.g., a subsea well 10). The connection assembly 24 includes complementary connectors 100 and 102. In the embodiment shown, the connector 100 (e.g., a pin-type connector) is located on the inboard or motor side of the assembly 24 and may attach to a housing 104 of the component 20 via a flange 106 and a fastening device receiving in apertures 108 and 1 10. One end of the pin connector 100 (not shown in FIG. 2) is connected to a power cable which, for instance, provides electrical power to the motor of the submersible component 20. The complementary connector 102 (e.g., a plug-type connector) is located on the seaboard side of the assembly 24 and has one end (not shown in FIG. 2) connected to the power cable (e.g., cable 22) which, for instance, provides electrical power to the assembly 24 from the surface of the well 10, such as from the wellhead 12 located on the seabed 14.

The pin connector 100 includes a pin assembly 112 disposed within a housing 114. Similarly, the plug connector 102 includes a plug assembly 116 disposed within a housing 118. The housings 114 and 118 include complementary interface portions 120 and 122, respectively, which are configured to engage with one another to provide a seal about a connection interface 124 between the pin assembly 112 and the plug assembly 116. As will be described in detail below, the interface portions 120 and 122 are configured to maintain the electrical integrity of the connection in the high temperature, high pressure, and high voltage environment in which the connection assembly 24 may be employed. For instance, in a subsea well environment, the connection assembly 24 may be exposed to temperatures up to 200° C. and differential pressures up to 10,000 psi, while withstanding an operating voltage of up to 10,000 Vac and an operating current up to 250 A.

Figure 3:
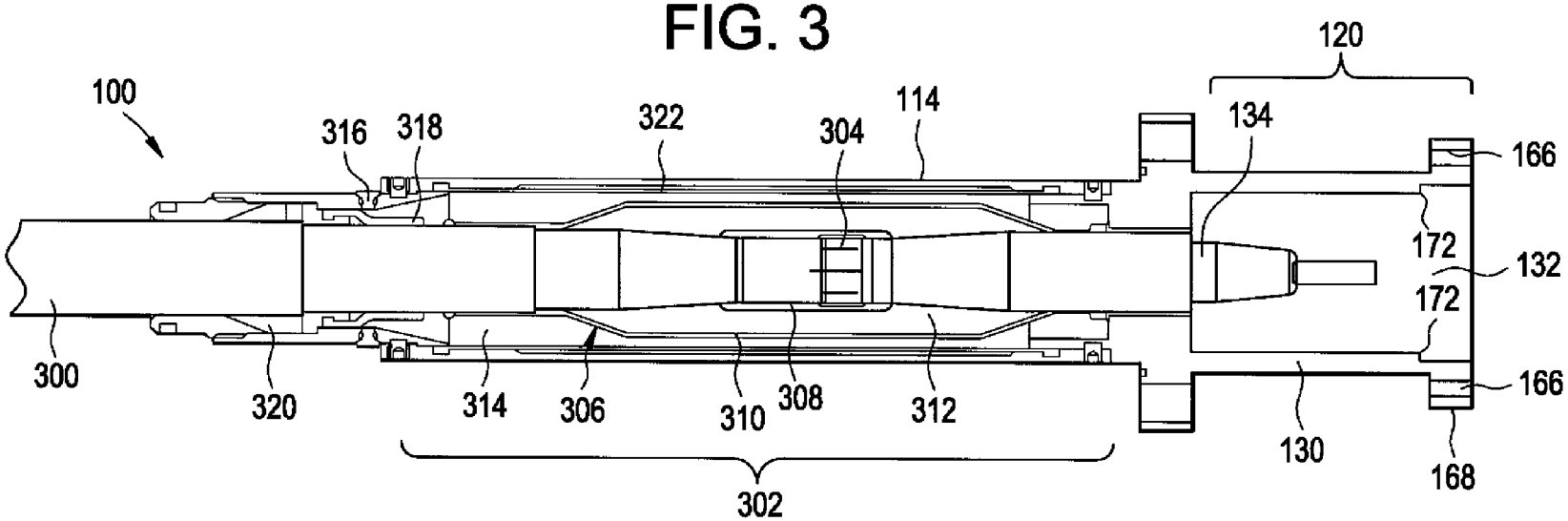
FIG. 3 illustrates an exemplary embodiment of a pin-type connector assembly that may be used with the connection assembly of FIG. 2.
Figure 4:
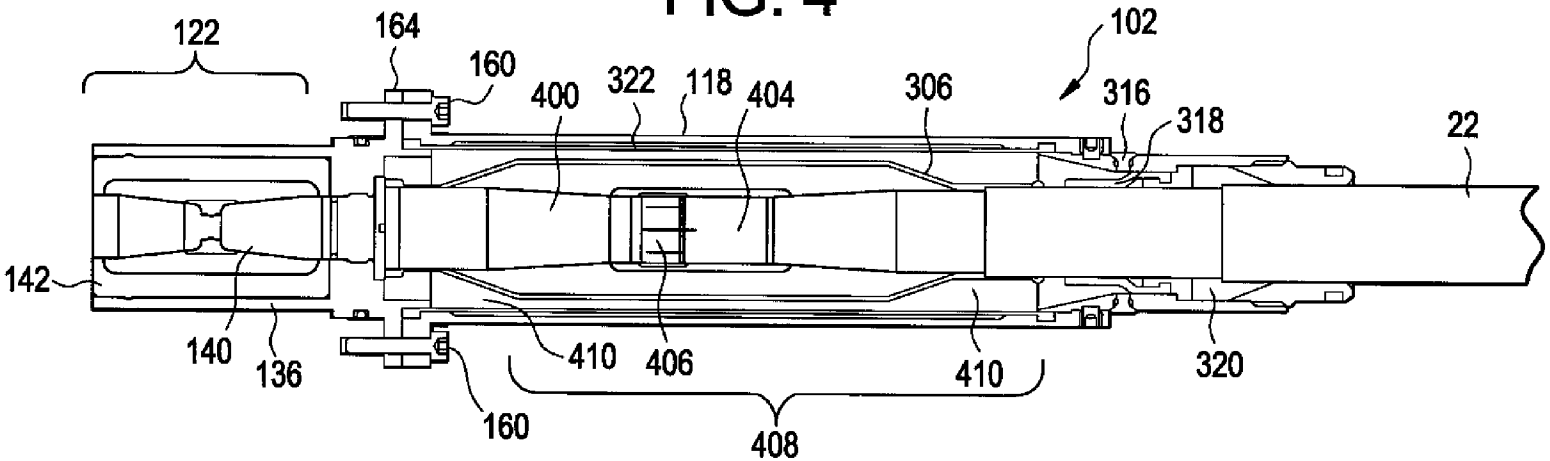
FIG. 4 illustrates an exemplary embodiment of a plug-type connector assembly that may be used with the connection assembly of FIG. 2.
Figure 5:
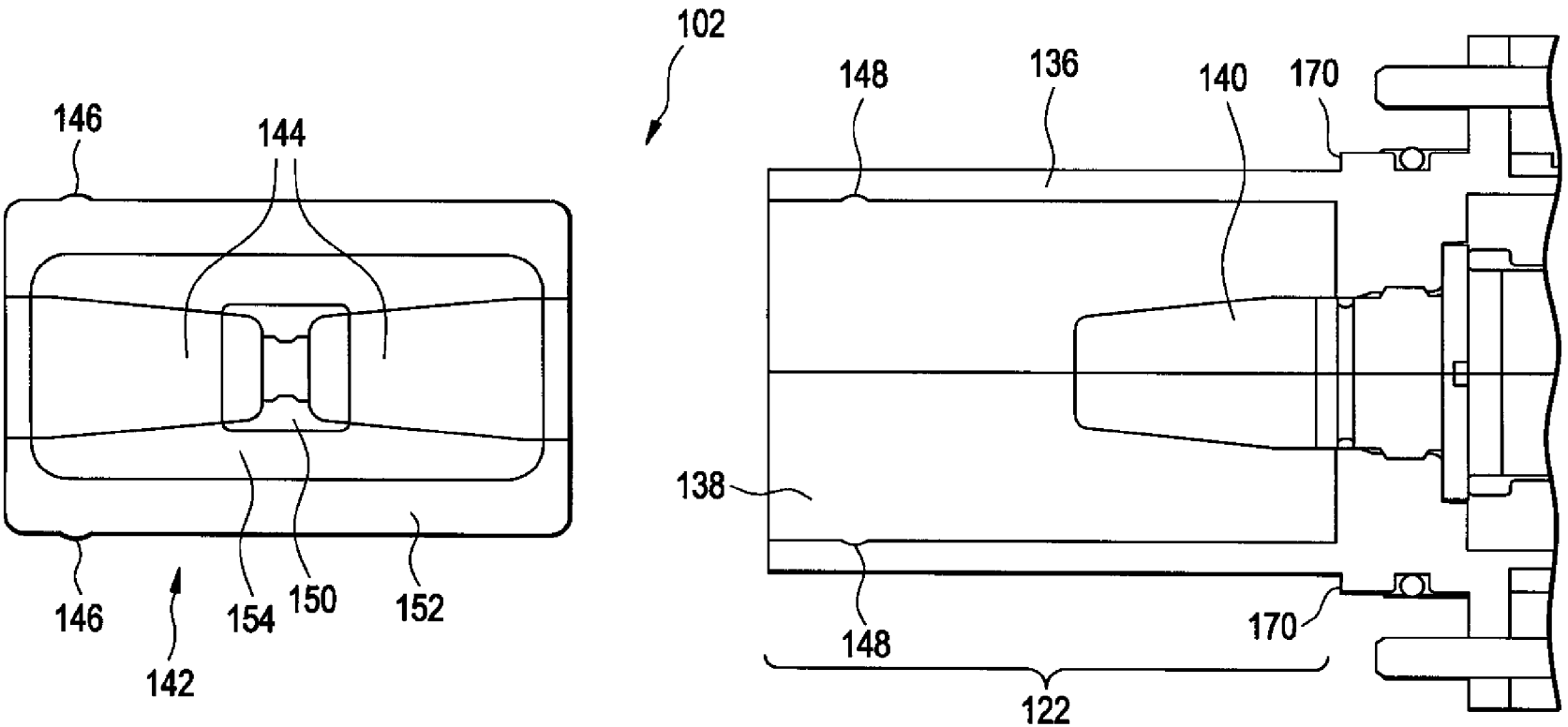
FIG. 5 is an exploded view of a portion of the plug-type connector assembly shown in FIG. 4.

The interface portions 120 and 122 may be best seen with reference to FIGS. 3, 4, and 5. Referring first to FIG. 3, the interface portion 120 of connector housing 114 includes a wall 130 that defines a chamber 132 into which a contact portion 134 of the pin assembly 112 extends. Referring to FIGS. 4 and 5, the interface portion 122 of connector housing 118 similarly includes a wall 136 that defines a chamber 138 into which a plug portion 140 of the plug assembly 116 extends. The chamber 138 also is configured to receive a grommet or boot 142 which assists in maintaining the electrical integrity of the connection interface 124. In one embodiment, the boot 142 includes a passageway 144 configured to receive the contact portion 134 and the plug portion 140 of pin assembly 112 and plug assembly 116. As shown in the exploded view provided in FIG. 5, the boot 142 may be retained within the chamber 138 via a detent or ridge 146 which engages with a radial groove 148 formed in the wall 136 of the connector housing 118. In other embodiments, the boot 142 may be retained within the chamber 138 by other means, such as by an adhesive.

The boot seal 142 may be made of an elastomeric or flexible material to ensure that the boot 142 tightly grips and substantially forms a seal with minimal voids about the contact portion 134 and plug portion 140. In some embodiments, the boot 142 may be formed using a three-stage molding process. In such embodiments, an innermost layer 150 and an outermost layer 152 of the boot 142 are made of a semiconductive elastomeric material, such as a carbon-filled elastomeric material. A middle layer 154 is made of an insulative material, such as silicone rubber or ethylene propylene diene monomer (EPDM) rubber or the like. By including multiple layers, the boot 142 may maintain the electrical integrity of the connection interface 124 by acting as a Faraday cage or shield. In other embodiments, the boot 142 may include a different number of layers or even simply a single layer, some of the layers may be made of a conductive material, and the layers may be made of a solid material or a material having openings, such as a mesh.

FIG. 2 shows the pin connector 100 and the plug connector 102 in a mated condition. To mate the plug connector 102 with the pin connector 100, the contact portion 134 of the pin assembly 112 is inserted into the passageway 144 of the boot 142. At the same time, the interface portion 122 of plug connector 102 is received within the chamber 132 of the pin connector 100, and the connectors 100 and 102 are brought into full engagement. In some embodiments, engagement of the connectors 100 and 102 may be assisted using fastening devices 160 which extend through apertures 166 through a flange 164 of the plug connector housing 1 18 and are received into threaded apertures 166 through a flange 168 of the pin connector housing 114. In the embodiment shown, the wall 136 of the interface portion 122 of the connector housing 118 includes shoulders 170. Corresponding notches 172 are formed in the wall 130 of the interface portion 120 of the pin connector housing 114. When the connectors 100 and 102 are fully engaged, the shoulders 170 abut the corresponding notches 172. Such an arrangement also may assist in maintaining the seal about the connection interface 124.

Figure 6:
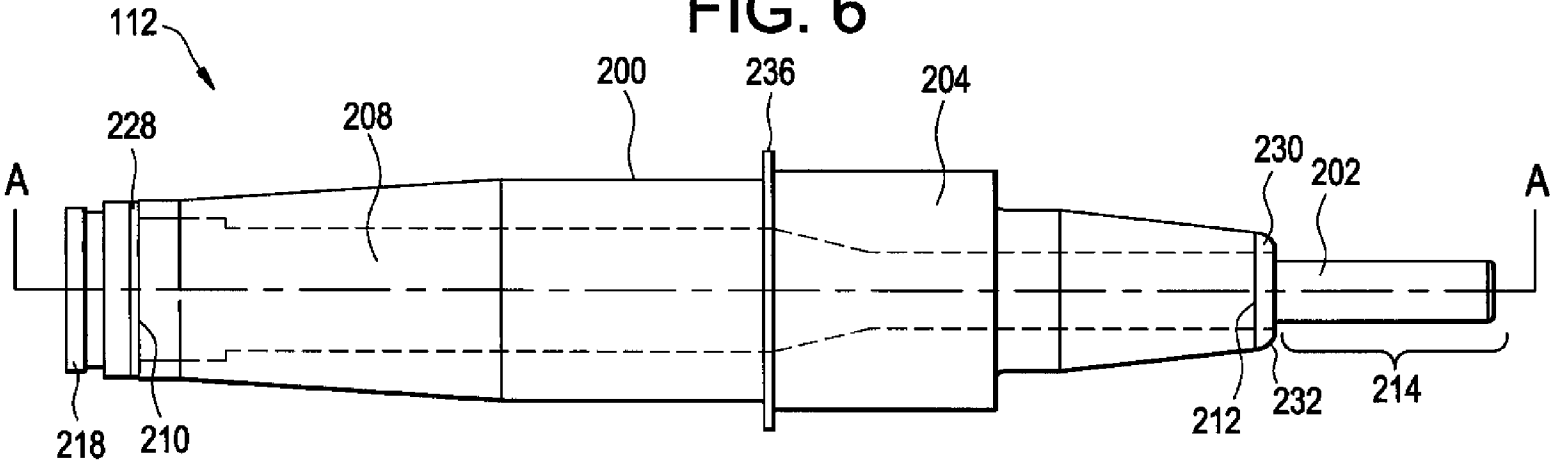
FIG. 6 illustrates an exemplary embodiment of a pin assembly that may be included in the connector assembly of FIG. 3.
Figure 7:
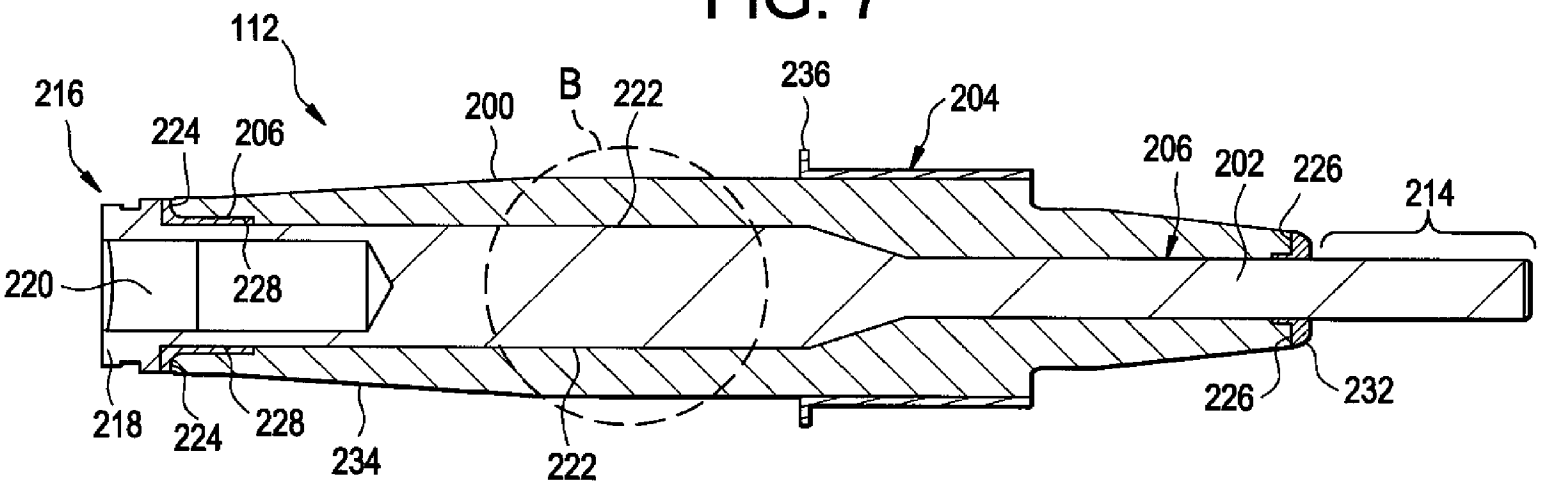
FIG. 7 is a cross-sectional view of the pin assembly of FIG. 6 taken generally along the line A-A.
Figure 8:
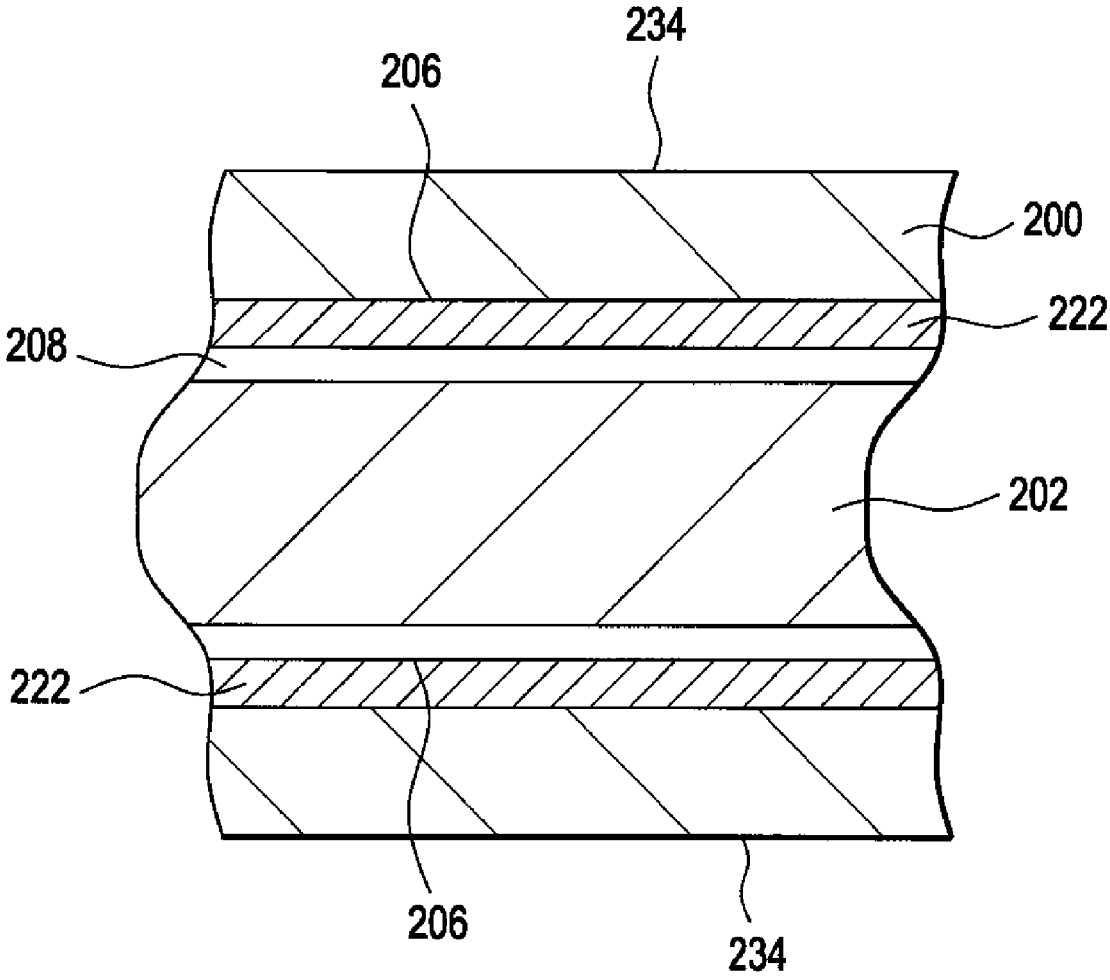
FIG. 8 is a close-up cross-section view of the pin assembly shown in FIGS. 6 and 7 taken generally in the region B-B.

Turning now to FIGS. 6 and 7, an embodiment of the pin assembly 112 for the pin connector 100 is illustrated. The pin assembly 112 includes an insulator body 200, a contact pin 202, and a collar or sleeve 204. To withstand the high temperatures and high pressure differentials that may be present in the operating environment (e.g., up to 200° C. and 10,000 psi), the insulator body 200 is made of a ceramic material, such as alumina or zirconia. As shown in FIG. 7 and the close-up view of FIG. 8, the insulator body 200 has an inner surface 206 that defines a passageway 208 that extends through the insulator body 200. The contact 202 is received within the passageway 208. The contact 202 is made of a conductive material, such as copper, and has a contact end 214 which extends from an open end 212 of the insulator body 200. The conductive contact 202 also has a cable connecting portion 216 which extends from the other open end 210 of the insulator body 200. The cable connecting portion 216 includes a flange 218 and a contact socket or recess 220 for connecting the pin assembly 112 to an insulated cable, such as a motor lead for the motor of the submersible component 20.

Because of the substantial difference in the thermal expansion coefficients of copper and ceramic, the contact 202 may be left to float throughout most of the length of the passageway 208. As a result, an air gap may exist between the contact 202 and the inner surface 206 of the insulator body 200, thus creating potential for electrical arcing within the passageway 208. Accordingly, in the embodiment shown, to eliminate or minimize arcing that might otherwise result due to the presence of the air gap, a conductive layer 222 is disposed on the inner surface 206 of the body 200. For instance, in some embodiments, the inner surface 206 may be metallized, such as by applying a thick film ink (e.g., a silver loaded glass liquid) that is then fired to form the conductive layer 222. Disposing a conductive layer 222 creates a Faraday cage about the contact 202 and thus eliminates the air gap from the electrical point of view. In some embodiments, the outer end surfaces 224 and 226 of the insulator body 200 also are metallized.

To retain the contact 202 within the insulator body 200, the cable connecting portion 216 of the contact 202 is attached to the insulating body 200. In some embodiments, rather than connect the portion 216 of the contact 202 directly to the metallized layer 222 of the body 200, an interface portion may be provided between the contact 202 and the metallized layer 222. For instance, in the embodiment shown in FIG. 7, the contact 202 may be attached to an interface portion, such as a flange 228. In some embodiments, the flange 228 may be made of a conductive material having a thermal expansion coefficient that is between the expansion coefficient of the contact 202 material and the insulator body 200 material to reduce the likelihood that the attachment point between the contact 202 and the insulator body 200 may crack or otherwise separate. In one embodiment, the flange 228 made be made of a nickel iron material, such as Kovar, the contact 202 may be made of copper, and the insulator body 200 may be made of alumina. The contact 202 is attached to the flange 228 in a manner suited to the types of material used, such as by brazing, soldering, welding, etc. The flange 228 also may be attached to the metallized layer 222 and/or the metallized outer end surface 224 of the insulator body 200 in an appropriate manner, such as by brazing, soldering, welding, etc. Alternatively, the flange 228 may be omitted and the cable connecting portion 216 may be directly attached to the metallized layer 222.

The pin assembly 112 also includes a conductive end cap 230 which is attached to the open end 212 of the insulator body 200. As shown in FIG. 7, the contact end 214 of the contact 202 extends through and floats within the end cap 230, and the end cap 230 assists with centralizing the contact 202 in the pin assembly 112. In some embodiments, the end cap 230 is made of a conductive material such as nickel iron, and is attached to the insulator body 200 such as by brazing the end cap 230 to the metallized inner surface 206 and/or outer end surface 226 of the insulator body 200. The outer surface 232 of the end cap 230 may be radiused to reduce the electrical field around the contact end 214 of the pin assembly 112.

The pin assembly 112 further includes the sleeve 204 which is disposed about and grips an outer surface 234 of the insulator body 200. The sleeve 204 includes a flange 236 that is connected to the housing 114 of the pin connector 100 to retain the pin assembly 112 within the housing 114 (see FIG. 2). In some embodiments, the sleeve 204 is made of a conductive material, such as stainless steel, although other types of conductive and nonconductive materials also may be used. To ensure that a substantially gas tight seal is formed between the chamber 132 and a cable receiving chamber 302 of the housing 114, the flange 236 of the sleeve 204 is fixedly attached to the housing 114, such as by welding or soldering. In addition, to provide a substantially gas tight seal between the outer surface 234 of the insulator body 200 and the sleeve 204, the outer surface 234 of the insulator body 200 may be precision ground to provide a substantially round cylindrical surface with a high surface finish in the range of approximately 2 to 4 micro-inches $R_a$ and/or glazed and the sleeve 204 may be shrink fit into place. Applying a glaze to the outer surface 234 also may seal the insulator body 200 and thereby prevent contamination of the insulator body 200 itself.

Returning to FIG. 3, the pin assembly 112 is shown retained within the pin connector housing 114 in a manner in which the assembly 112 extends between the interface chamber 132 and the cable receiving chamber 302. An insulated cable 300 (e.g., a power lead for the motor of the submersible component 20) is received within the cable receiving portion 302 and connected to the cable connecting portion 216 of the contact 202. For instance, the insulation on the cable 300 may be removed to reveal an appropriate length of the electrical conductor contained within the cable 300. The exposed conductor may then be fitted with a crimp contact such that the crimp may engage with the contact socket 220 of the contact pin 202. The crimp contact may then be crimped to the cable conductor and attached to the flange 218 of the contact pin 202 and retained to the pin assembly 112 using a self locking collet 304.

Electrical stresses are managed within the cable receiving chamber 302 by using a cable boot 306 that securely fits about the cable/contact pin interface. In one embodiment, the cable boot 306 is molded of an elastomeric material and may include multiple layers, such as at least three layers. In such an embodiment, an inner layer 308 and an outer layer 310 of the boot 306 may be molded from a semiconductive material, such as a carbon-filled elastomeric material. A middle layer 312 may be made of an insulative material, such as silicone rubber, EPDM rubber, or the like. When fitted about the cable/plug interface, the cable boot 306 acts as a Faraday cage and, thus, minimizes electrical stresses within the cable receiving chamber 302. In some embodiments, the unoccupied volume 314 between the cable boot 306 and the housing 114 may be filled with a gel compound (e.g., silicone gel or grease) or a dielectric oil to eliminate any voids and to protect the cable/plug interface from mechanical stresses. The gel compound or oil may be injected into the unoccupied volume via a filler tube and syringe through vent port and screw 316.

The cable 300 may be sealed within the cable receiving chamber 302 of the housing 114 by a resilient or spring-loaded cable seal 318. The cable 300 may be further secured in place by a cable clamping collet 320.

In some embodiments, a flexible pressure compensation diaphragm 322 may be secured within the cable receiving chamber 302 to compensate for pressure and thermal expansion and contraction of the gel compound.

FIG. 4 illustrates one embodiment of the plug connector 102 that may be mated with the pin connector 100. The plug connector 102 includes an insulator body 400 made of, for example, a high temperature thermoplastic material, such as a polyetheretherketone (PEEK) insulating material, although a ceramic material also may be used. One end of the insulator body 400 includes the plug portion 140 having a plug receptacle for receiving the contact end 214 of the mating pin connector 100. The other end of the insulating body 400 is configured to attach to an insulated cable, such as the power cable 22. The cable 22 is attached to the insulator body 400 and makes electrical contact with the plug receptacle of the plug portion 140 via a crimp contact connection 404 and a self-locking collet 406. The insulator body 400 is retained within the connector housing 118 in any appropriate manner, such as by using a stainless steel threaded ring inserted into the PEEK molding during manufacture.

Similar to the pin connector housing 114 described above, the plug connector housing 118 includes a cable receiving chamber 408 in which the interface between the cable 22 and plug assembly 116 is retained. The cable receiving chamber 408 may be implemented in the same manner as the cable receiving chamber 302 described above. For instance, the cable receiving chamber 408 may contain a cable boot 306 to manage the electrical stresses, a gel compound may fill the unoccupied areas 410 in the cable receiving chamber, and the pressure compensation diaphragm 322 may be secured within the housing 118 and used to compensate for expansion and contraction of the gel compound. In addition, the cable 22 may be sealed within the cable receiving chamber 408 using the resilient cable seal 318 and retained using the clamping collet 320.

Although the invention has been described with respect to use for providing power to a submersible component in a subsea well, it should be understood that the connection assembly and connector configurations described herein may be used to provide an electrical connection to any of a variety of electrical components, particularly electrical connections that are exposed to harsh conditions such as the high pressure, high temperature conditions of a deepwater environment.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. An electrical connector for use in a deep water application, comprising:

a ceramic body having a metallized inner surface defining a passageway extending through the ceramic body;

a conductive contact disposed in the passageway, the conductive contact having a cable connection end extending from a first open end of the passageway and a contact end extending from a second open end of the passageway; and a sleeve disposed about an outer surface of the ceramic body to exert a gripping force on the ceramic body.

2. The electrical connector as recited in claim 1, comprising a connector housing to receive the ceramic body, the housing having a first chamber and a second chamber, wherein the ceramic body extends between the first and second chambers and wherein the sleeve is attached to the connector housing to seal the first chamber from the second chamber.

3. The electrical connector as recited in claim 1, wherein the sleeve is shrink fit about the outer surface of the ceramic body.

4. The electrical connector as recited in claim 1, wherein the outer surface of the ceramic body is glazed.

5. The electrical connector as recited in claim 1, wherein the outer surface of the ceramic body is precision ground.

6. The electrical connector as recited in claim 1, comprising a conductive end cap disposed at the second open end of the ceramic body, the conductive end cap having an opening therethrough, the contact end of the conductive contact extending through the opening.

7. The electrical connector as recited in claim 6, wherein the conductive end cap has a radiused outer surface to reduce the electrical field about the contact portion.

8. The electrical connector as recited in claim 1, comprising an interface portion attached between the cable connection end of the conductive contact and the metallized inner surface.

9. The electrical connector as recited in claim 8, wherein the interface portion is made of a nickel iron material.

10. A method of providing an electrical connection to a submersible component disposed in a well, comprising:

providing a ceramic body having a passageway extending therethrough;

metallizing a wall of the passageway;

disposing a conductive contact in the passageway, the conductive contact having a contact end extending from a first end of the passageway and a cable connecting end extending from a second end of the passageway;

attaching the cable connecting end to the ceramic body;

disposing a sleeve about an outer surface of the ceramic body such that the sleeve substantially seals about the ceramic body; and attaching the cable connecting end to an electrical conductor adapted to provide electrical power to the submersible component.

11. The method as recited in claim 10, wherein disposing the sleeve about the outer surface of the ceramic body comprises precision grinding the outer surface of the ceramic body, and shrink fitting the conductive sleeve about the precision ground outer surface.

12. The method as recited in claim 10, comprising:

providing a housing having a first chamber and a second chamber;

disposing the ceramic body in the housing such that the ceramic body extends between the first chamber and the second chamber; and attaching the sleeve to the housing to seal the first chamber from the second chamber.

13. The method as recited in claim 12, comprising engaging the contact end with a complementary connector at a connection interface, wherein the contact end is disposed in the second chamber and the cable connecting end is disposed in the first chamber.

14. The method as recited in claim 13, comprising providing a Faraday cage to manage an electrical field at the connection interface.

15. The method as recited in claim 14, wherein providing the Faraday cage comprises receiving a boot within the first chamber, the boot having a passageway for receiving a portion of the ceramic body that extends into the first chamber and a complementary portion of the complementary connector.

16. The method as recited in claim 15, wherein the boot comprises an innermost semiconductive layer, an outermost semiconductive layer, and an insulative layer disposed between the innermost and outermost semiconductive layers.

17. A system, comprising:

an electrical submersible component;

a cable having an electrical conductor to provide electrical power to the electrical submersible component; and a connection assembly adapted to couple the electrical conductor to the electrical submersible component, the connection assembly comprising:

a first connector having a first housing having a first chamber and a second chamber, a ceramic body extending between the first and second chambers, the ceramic body having a metallized inner surface defining a passageway extending through the ceramic body, a conductive contact extending through the passageway, and a sleeve disposed about an outer surface of the ceramic body and configured to seal the first chamber from the second chamber; and a complementary connector having a complementary conductive contact configured to attach to the electrical conductor, wherein the complementary conductive contact engages with the conductive contact to provide electrical power to the electrical submersible component.

18. The system as recited in claim 17, wherein the electrical submersible component is located in a deepwater environment.

19. The system as recited in claim 17, wherein the conductive contact comprises a cable connecting end disposed in the first chamber and a contact end disposed in the second chamber, and wherein the system further comprises a flexible boot received within the second chamber when the complementary conductive contact is engaged with the conductive contact, the flexible boot configured to provide a Faraday cage about a connection interface between the complementary conductive contact and the conductive contact.

20. The system as recited in claim 19, wherein the flexible boot comprises an innermost layer made of a semiconductive material, an outermost layer made of a semiconductive material, and a middle layer disposed between the innermost and outermost layers, the middle layer made of an insulative material.

21. The system as recited in claim 17, wherein the sleeve includes a flange, and wherein the flange is welded to the first connector housing to seal the first chamber from the second chamber.

22. The system as recited in claim 21, wherein the sleeve is shrink fit about the outer surface of the ceramic body.

23. The system as recited in claim 22, wherein the outer surface of the ceramic body is precision ground.

* * * * *